US008152457B2

(12) United States Patent
Flanagan et al.

(10) Patent No.: US 8,152,457 B2
(45) Date of Patent: Apr. 10, 2012

(54) COMPRESSOR CLEARANCE CONTROL SYSTEM USING BEARING OIL WASTE HEAT

(75) Inventors: Mark W. Flanagan, Simpsonville, SC (US); Steven W. Tillery, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 733 days.

(21) Appl. No.: 12/354,066

(22) Filed: Jan. 15, 2009

(65) Prior Publication Data

US 2010/0178161 A1 Jul. 15, 2010

(51) Int. Cl.

| | |
|---|---|
| ***F01D 5/08*** | (2006.01) |
| ***F01D 5/18*** | (2006.01) |
| ***F01D 25/08*** | (2006.01) |
| ***F04D 29/58*** | (2006.01) |

(52) U.S. Cl. ..... 415/177; 415/173.1; 415/180

(58) Field of Classification Search ..... 415/173.1, 415/177, 180

See application file for complete search history.

(56) References Cited

U.S. PATENT DOCUMENTS

| | | | | |
|---|---|---|---|---|
| 4,069,662 | A * | 1/1978 | Redinger et al. | 60/226.1 |
| 6,027,304 | A | 2/2000 | Arar et al. | |
| 6,435,823 | B1 * | 8/2002 | Schroder | 415/173.1 |
| 6,626,635 | B1 * | 9/2003 | Prowse et al. | 415/1 |
| 2006/0042266 | A1 | 3/2006 | Albers et al. | |
| 2007/0039305 | A1 | 2/2007 | Taha et al. | |
| 2007/0240400 | A1 | 10/2007 | Smith et al. | |
| 2008/0267769 | A1 | 10/2008 | Schwarz et al. | |

* cited by examiner

*Primary Examiner* — Stephen W Smoot
*Assistant Examiner* — Vicki B Booker
(74) *Attorney, Agent, or Firm* — Sutherland Asbill & Brennan, LLP

(57) ABSTRACT

The present application provides a compressor clearance control system for a gas turbine engine having an oil recirculation system with a flow of oil therein and a compressor with a casing and a number of rotor blades. The compressor clearance control system may include a casing heat exchanger positioned about the casing of the compressor and a conduit in communication with the casing heat exchanger and the oil recirculation system so as to heat the casing of the compressor with the flow of oil from the oil recirculation system.

15 Claims, 2 Drawing Sheets

COMPRESSOR CLEARANCE CONTROL SYSTEM USING BEARING OIL WASTE HEAT

TECHNICAL FIELD

The present application relates generally to gas turbine engines and more particularly relates to a compressor clearance control system for providing front end rotor blade clearance or other types of clearance control through the use of bearing oil waste heat.

BACKGROUND OF THE INVENTION

When overall power demand is low, power producers often turn their power generation equipment to a low power level so as to conserve fuel. In the case of a gas turbine engine, the inlet guide vanes about a compressor inlet may be closed to a minimum angle so as to reduce the airflow therethrough and the overall power output. Specifically, the air passing through the inlet guide vanes may experience a significant pressure drop at the low inlet guide vane angles. The front end of the compressor essentially acts as a turbine and extracts energy from the airflow in a phenomenon called turbining. The low pressure thus may cause the temperature of the airflow about the compressor inlet casing to drop quickly. Such low temperatures may require more steady state clearances between the casing and the rotor blades to allow for stabilization.

Because the metal casing of the compressor has a slower thermal response time than the rotor blades, the rotor blades may expand faster than the casing so as to cause the rotor blades to close in on the casing and potentially rub thereagainst when in transition to higher loads or in an overspeed condition. Rubbing may cause early rotor blade damage and possible failure. As a result, operational rotor blade/casing clearances must accommodate these differing expansion rates. These clearances effect and thereby limit the amount of core flow that may be pulled into the compressor.

There is therefore a desire for improved clearance control systems and methods for a compressor so as to improve overall gas turbine engine performance and efficiency. Preferably, the improved compressor clearance control systems and methods also should address turbining during low or no load conditions as well rotor blade rubbing during load transitions. Specifically, reducing the range of clearances over the operating regime without the danger of not enough clearances (rubbing, damage) or the danger of too much clearance (loss of performance, stall, damage).

SUMMARY OF THE INVENTION

The present application thus provides a compressor clearance control system for a gas turbine engine having an oil recirculation system with a flow of oil therein and a compressor with a casing and a number of rotor blades. The compressor clearance control system may include a casing heat exchanger positioned about the casing of the compressor and a conduit in communication with the casing heat exchanger and the oil recirculation system so as to heat the casing of the compressor with the flow of oil from the oil recirculation system.

The present application further provides a method of providing clearance control for a gas turbine engine having an oil recirculation system with a flow of oil therein and a compressor with a casing and a number of rotor blades. The method may include the steps of rotating the rotor blades within the casing, flowing oil through a bearing housing so as to gain heat therein, directing the flow of oil about the casing of the compressor, exchanging heat between the flow of oil and the casing, and thermally expanding the casing or preventing the casing from thermally contracting.

The present application further provides for a compressor clearance control system for a gas turbine engine having a compressor with a casing and a number of rotor blades. The compressor clearance control system may include an oil recirculation system with a flow of oil therein in communication with the compressor, a casing heat exchanger positioned about the casing of the compressor, and a conduit in communication with the casing heat exchanger and the oil recirculation system so as to heat the casing of the compressor with the flow of oil from the oil recirculation system.

These and other features and improvements of the present application will become apparent to one of ordinary skill in the art upon review of the following detailed description when taken in conjunction with the several drawings and the appended claims.

DETAILED DESCRIPTION

Figure 1:
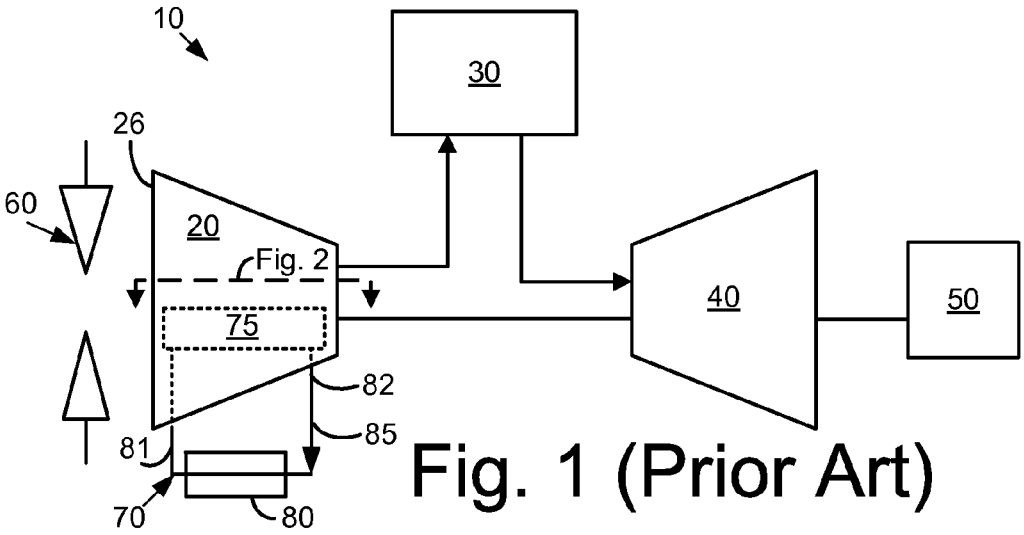
Fig. 1 (Prior Art)
FIG. 1 is a schematic view of a known gas turbine engine.
Figure 2:
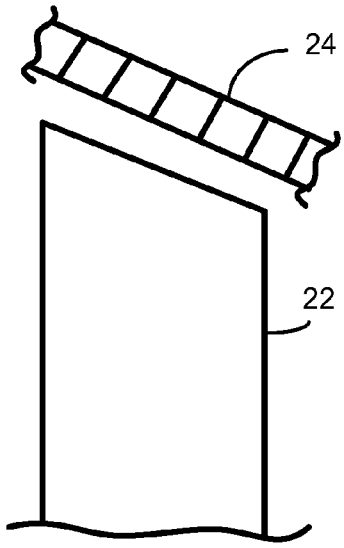
Fig. 2 (Prior Art)
FIG. 2 is a cross-sectional view of a rotor blade positioned about a compressor casing.

Referring now to the drawings in which like numerals refer to like elements throughout the several views, FIGS. 1 and 2 show a schematic view of a gas turbine engine 10. As is known, the gas turbine engine 10 may include a compressor 20 to compress an incoming flow of air. The compressor 20 includes a number of rotor blades 22 positioned within a casing 24. The compressor 20 delivers the compressed flow of air to a combustor 30. The combustor 30 mixes the compressed flow of air with a flow of fuel and ignites the mixture. (Although only a single combustor 30 is shown, the gas turbine engine 10 may include any number of combustors 30.) The hot combustion gases are in turn delivered in turn to a turbine 40. The hot combustion gases drive the turbine 40 so as to produce mechanical work. The mechanical work produced in the turbine 40 drives the compressor 20 and an external load 50 such as an electrical generator and the like. The gas turbine engine 10 may use natural gas, various types of syngas, and other types of fuels.

The gas turbine engine 10 may be a 9FA turbine or a similar device offered by General Electric Company of Schenectady, N.Y. Other types of gas turbine engines 10 may be used herein. The gas turbine engine 10 may have other configurations and use other types of components. Multiple gas turbine engines 10, other types of turbines, and/or other types of power generation equipment may be used together.

Load control for the gas turbine engine 10 may be possible in part through the use of a number of inlet guide vanes 60 positioned about an inlet 26 of the compressor 20. Specifically, the output of the gas turbine engine 10 may be modulated by changing the position of the inlet guide vanes 60 so as to vary the amount of air entering the compressor 20.

The gas turbine engine 10 also may use a bearing oil recirculation system 70. The oil stream lubricates the bearings about the rotor and other components. The bearing oil recirculation system 70 removes waste heat from the oil stream that the oil gains as it passes through a bearing housing 75. As is known, the bearing oil recirculation system 70 may include a bearing oil heat exchanger 80 in communication with the compressor 20. The bearing oil recirculation system 70 may have an input conduit 81 and an output conduit 82 in communication with the bearing housing 75 and the bearing oil heat exchanger 80. An oil stream 85 may gain about 50 to about 60 degrees Fahrenheit (about 10 to about 15.6 degrees Celsius) as it passes through the bearing housing 75. The temperature gain may vary. This waste heat is generally relatively low grade heat and, as such, the heat is usually vented or otherwise dissipated. Other methods and configurations may be used herein.

Figure 3:
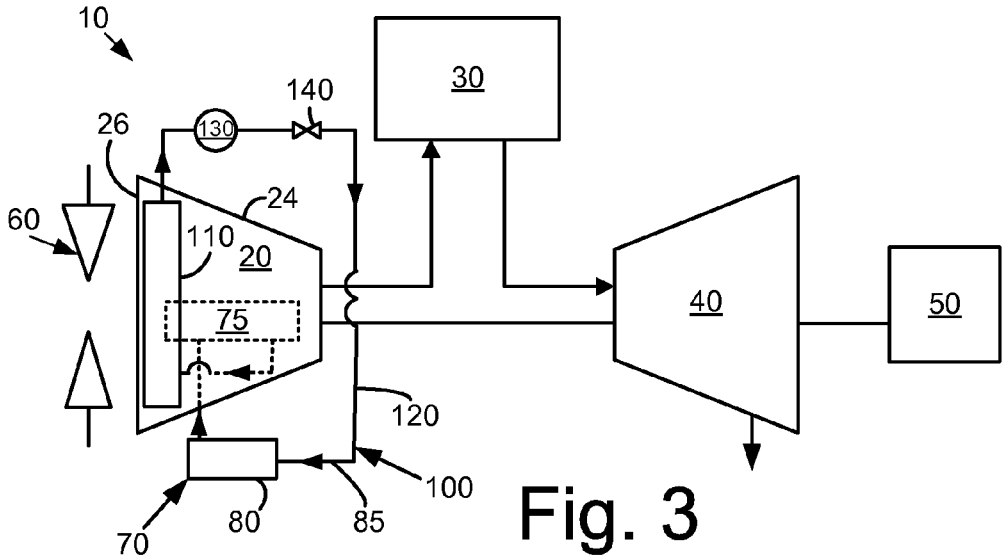
FIG. 3 is a schematic view of a gas turbine engine with a compressor clearance control system as is described herein.

FIG. 3 shows a compressor clearance control system 100 as is described herein. The compressor clearance control system 100 may be installed onto the gas turbine engine 10 as described above. The compressor clearance control system 100 likewise may be used with other types of turbine systems.

The compressor clearance control system 100 may include a compressor casing heat exchanger 110. The casing heat exchanger 110 may be any type of heat exchanger that transfers heat to the casing 24 of the compressor 20 about the inlet 26 or otherwise. The compressor casing heat exchanger 110 may be used in any stage or in any position. The compressor clearance control system 100 further includes one or more conduits 120 in communication with the bearing housing 75 of the bearing oil recirculation system 70 of the compressor 20. Specifically, the hot bearing oil stream 85 may pass through the casing heat exchanger 110 so as to warm the casing 24 of the compressor 20. After passing through the casing heat exchanger 110, the oil stream 85 then may be pumped back to the bearing oil heat exchanger 80. A pump 130 may be positioned about the conduit 120 if needed. Likewise, one or more valves 140 may be positioned on the conduit 120 as may be required. The oil stream 85 may flow through the casing heat exchanger 110 in any direction.

The heat from the hot bearing oil stream 85 of the bearing housing 75 is thus transferred to the metal of the casing 24 about the inlet 26 of the compressor 20. As such, shrinkage or thermal contraction of the casing 24 of the compressor 20 may be controlled so as to avoid rubbing by the rotor blades 22. Likewise, expansion of the casing 24 may be promoted. The compressor clearance control system 100 thus may be used when the inlet guide vanes 60 are close to or about at a minimum angle due to, for example, low load or no load conditions. Likewise, the compressor clearance control system 100 may be used in cold ambient conditions and during load transitions. The gas turbine engine 10 thus may be turned down to a lower power with less of a chance for rotor blade rubbing due to turbining or otherwise. Likewise, the inlet guide vanes 60 may be closed to a lower angle so as to turn down even further the power output.

The compressor clearance control system 100 not only permits lower turndown, but also may promote higher overall power output. Overall operational rotor blade tip clearances may be tightened given the increased controllability over the casing temperature via longer rotor blades 22. Specifically, tightening the rotor blade clearances should result in a power output increase. The improvement will vary greatly for different types of turbines. Moreover, the compressor clearance control system 100 uses waste heat from the bearing housing 75 so as to avoid the efficiency penalty associated with known inlet bleed heat systems and other known techniques.

The compressor clearance control system 100 may be installed in new or existing gas turbine engines 10. The compressor clearance control system 100 may be used on any machine where turbining or active clearance control may be an issue.

Figure 4:
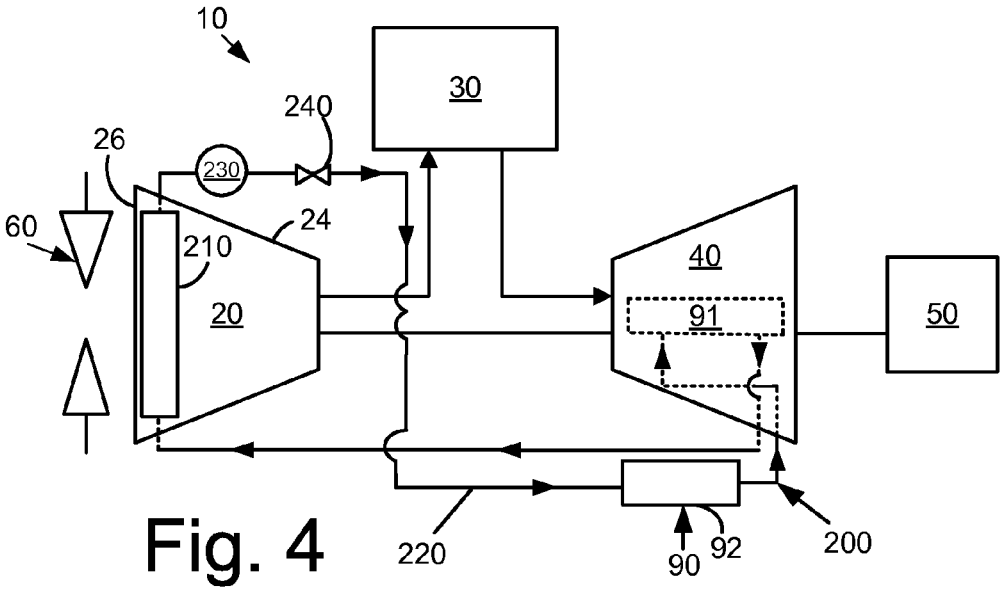
FIG. 4 is a schematic view of a gas turbine engine with an alternative embodiment of the compressor clearance control system as is described herein.

FIG. 4 shows a further embodiment of a compressor clearance control system 200. This embodiment also includes a casing heat exchanger 210 positioned on the casing 24 of the compressor 20 about the inlet 26. In this embodiment, the turbine 40 also includes a bearing oil recirculation system 90 with a bearing housing 91 in communication with a turbine bearing oil heat exchanger 92. The compressor clearance control system 200 also includes one or more conduits 220 in communication with the bearing housing 91 of the bearing oil recirculation system 90 of the turbine 40. Specifically, the hot bearing oil stream may pass through casing heat exchanger 210 so as to warm the casing 24 of the compressor 20. After passing through the casing heat exchanger 210, the oil stream 85 then may be pumped back to the bearing oil heat exchanger 92. A pump 230 may be positioned about the conduit 220 if needed. Likewise, one or more valves 240 may be positioned on the conduit 220 as may be required. The oil stream 85 may flow through the casing heat exchanger 210 in any direction. Other types of heat and/or oil circulation systems may be used herein.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A compressor clearance control system for a gas turbine engine having a compressor with a casing and a number of rotor blades, comprising:

a casing heat exchanger positioned about the casing of the compressor; and an oil recirculation system in communication with the casing heat exchanger, the oil recirculation system comprising:

a bearing oil housing;

a flow of oil flowing through the bearing oil housing so as to gain heat therein; and at least one conduit in communication with the casing heat exchanger and the bearing housing of the oil recirculation system so as to heat the casing of the compressor with the flow of oil from the oil recirculation system.

2. The compressor clearance control system of claim 1, further comprising a pump positioned on the one or more conduits.

3. The compressor clearance control system of claim 1, further comprising a valve positioned on the one or more conduits.

4. The compressor clearance control system of claim 1, further comprising a plurality of inlet guide vanes positioned about compressor.

5. The compressor clearance control system of claim 1, wherein the bearing oil housing is a compressor bearing oil housing.

6. The compressor clearance control system of claim 1, wherein the bearing oil housing is a turbine bearing oil housing.

7. The compressor clearance control system of claim 1, further comprising a bearing oil heat exchanger in communication with the bearing oil housing.

8. The compressor clearance control system of claim 7, wherein the bearing oil heat exchanger is a turbine bearing oil heat exchanger.

9. The compressor clearance control system of claim 7, wherein the bearing oil heat exchanger is a compressor bearing oil heat exchanger.

10. A method of providing clearance control for a gas turbine engine having an oil recirculation system with a flow of oil therein and a compressor with a casing and a number of rotor blades, comprising:

rotating the number of rotor blades within the casing;

flowing oil through a bearing housing so as to gain heat therein;

directing the flow of oil about the casing of the compressor;

exchanging heat between the flow of oil and the casing; and thermally expanding the casing or preventing the casing from thermally contracting.

11. The method of claim 10, wherein the step of exchanging heat comprises flowing the oil through a casing heat exchanger positioned about the casing.

12. The method of claim 10, further comprising reducing a clearance between the casing and the number of rotor blades by increasing the size of the number of rotor blades.

13. The method of claim 10, wherein the step of flowing oil through a bearing housing comprises flowing oil through a compressor bearing housing.

14. The method of claim 10, wherein the step of flowing oil through a bearing housing comprises flowing oil through a turbine bearing housing.

15. The method of claim 10, further comprising the step of flowing the oil through a bearing oil heat exchanger.

* * * * *